US011697052B2

(12) United States Patent
Lee

(10) Patent No.: US 11,697,052 B2
(45) Date of Patent: Jul. 11, 2023

(54) GOLF HIP-TURN TRAINING DEVICE

(71) Applicant: Momentia GT, Seoul (KR)

(72) Inventor: Sung Hyuk Lee, Seoul (KR)

(73) Assignee: Momentia GT, Seoul (KR)

( * ) Notice: Subject to any disclaimer, the term of this patent is extended or adjusted under 35 U.S.C. 154(b) by 0 days.

(21) Appl. No.: 17/583,093

(22) Filed: Jan. 24, 2022

(65) Prior Publication Data

US 2022/0233937 A1 Jul. 28, 2022

(51) Int. Cl.
*A63B 69/36* (2006.01)
*A63B 69/00* (2006.01)

(52) U.S. Cl.
CPC ..... *A63B 69/0059* (2013.01); *A63B 69/36* (2013.01)

(58) Field of Classification Search
CPC . A63B 69/0059; A63B 69/36; A63B 21/0442; A63B 21/0557; A63B 21/4009; A63B 69/3608
USPC ..... 473/212–216, 121–231, 247, 266, 277, 473/422, 424; 482/121–130
See application file for complete search history.

(56) References Cited

U.S. PATENT DOCUMENTS 5,924,933 A * 7/1999 Pacheco ..... A63B 69/3608 473/277
6,129,638 A * 10/2000 Davis ..... A63B 69/0059 473/277
7,632,192 B2 * 12/2009 Begert ..... A63B 21/00061 473/215
9,498,692 B2 * 11/2016 Bledsoe ..... A63B 21/4025
2011/0021329 A1 * 1/2011 Dunne ..... A63B 21/0552 482/124
2014/0200122 A1 * 7/2014 Hallmark ..... A63B 21/4025 482/129
2017/0252621 A1 * 9/2017 Ross ..... A63B 69/0059

FOREIGN PATENT DOCUMENTS

KR 10-0639806 B1 10/2006
KR 10-1846927 B1 4/2018

* cited by examiner

*Primary Examiner* — Nini F Legesse

(74) *Attorney, Agent, or Firm* — Loza & Loza LLP; Jun S. Ha

(57) ABSTRACT

A golf hip-turn training device according to the present disclosure includes: an anchor section including a body having a band shape, a first ring coupled at a second side of the body, and a fixer that is formed at a first side of the body and configured to be coupled to a fixed object; a resistance load section including an elastic member that has a rope shape, and one or more second rings that are coupled to ends of the elastic member and fastened to the first ring; and a strap section having a loop band shape and including a third ring coupled at a first side of the strap section to hold the elastic member and to enable the elastic member to pivot around the third ring, wherein a second side is formed to wrap around a hip and a portion of a femoral region of a user.

6 Claims, 8 Drawing Sheets

GOLF HIP-TURN TRAINING DEVICE

PRIORITY CLAIM

This application claims priority from Korean Patent Application No. 20-2021-0000277, filed on Jan. 27, 2021, which is hereby incorporated by reference for all purposes as if fully set forth herein.

TECHNICAL FIELD

The technology discussed below relates generally to wireless communication systems, and more particularly, to a golf training device.

INTRODUCTION

Golf is a sport where improving postures are very important in improving one's game. For example, during a golf swing, a head position and a backbone angle should be maintained until a golf club hits a golf ball, for accurate hitting of the ball. With Golfers generally visit driving ranges to practice their golf swings. However, visiting driving ranges require travel time and costs associated with the driving range. Some golfers even hire golf instructors to practice or to correct their golf swings, which can be even more costly. Therefore, many golfers often look for more convenient and less costly options in practicing their golf swings.

BRIEF SUMMARY OF SOME EXAMPLES

The following presents a summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a form as a prelude to the more detailed description that is presented later.

The present disclosure is for training for correcting a swing posture while developing legs, hip muscles, and the core muscles of the abdominal muscles for correct hip-turn in golf swing, and particularly, relates to a golf hip-turn training device for practicing correct golf hip-turn through resistance exercise irrespective of place using a door anchor and an elastic band.

The present disclosure has been made in an effort to solve the problems described above and an objective of the present disclosure is to provide a golf hip-turn training device that can easily assist in strengthening of core muscles and can correct a hip-turn posture using resistance by hip-turn irrespective of place.

Another objective of the present disclosure is to provide a golf hip-turn training device that enables a user to select the intensity of exercise resistance in training because it uses replaceable elastic bands, to develop core muscles for correct hip-turn through resistance exercise because it is mounted directly on the user's body while wrapping around the hips, and to correct postures irrespective of place because it is simply carried and installed.

A golf hip-turn training device according to the present disclosure includes: an anchor section including a body that has a band shape, a fixer that is formed at a first side of the body and configured to be coupled to a fixed object, and a first ring coupled at a second side of the body; a resistance load section including an elastic member that has a rope shape and pivots on a first side of the strap section, and one or more second rings that are coupled to both ends of the elastic member and fastened to the first ring; and a strap section having a loop band shape and having a third ring coupled at a first side thereof to hold the elastic member therethrough, wherein a second side of the strap section is formed to wrap around a hip and a femoral region of a user when the strap section is worn by the user.

Further, the fixer is formed in a circular pipe shape of which the longitudinal direction corresponds to the width direction of the body.

Further, the anchor section further includes a fourth ring coupled to the first side of the body and the fixer is a chain that is wound around the fixed object and coupled to the fourth ring at both ends, respectively.

Further, the strap section includes: an extension coupled to the third ring with sides of the extension 51 facing each other being in contact with each other; a wrapper connected with the extension and formed in a loop band shape to fit a user's leg through a loop of the wrapper; and a pair of bases, each formed by maintaining or increasing the width of a predetermined region of the wrapper to wrap around a hip and a portion of a femoral region when the strap section is worn by the user, each of the pair of bases having an anti-slip pad disposed on the inner side thereof.

Further, each of the widths of the first base and the second base are two times the width of the wrapper.

Further, the body and the extension are formed in a belt type that enables adjustment of a length.

According to the present disclosure, since the training device is worn such that the strap section strengths the core muscles, that is, supports a latissimus dorsi muscle, a hip, and a femoral region, an individual may strengthen the core muscles for stable hip-turn even by himself/herself due to the interaction of the hip-turn direction and the resistance load for returning to the initial state of the elastic member.

Further, in some aspects, there is an effect that it is possible to determine whether the posture is correct or wrong on the basis of whether the bases are kept in close contact, so an individual can achieve a stable hip-turn posture even by himself/herself, and there is an effect that since elastic bands can be replaced, users can use the training device irrespective of the state of their muscular, and the training device can be installed and used irrespective of place because it can be easily carried.

Further, in some aspects, there is an effect that when a right-handed golfer practices resistance exercise with a strap wound around the right leg near the crotch and then wound counter-clockwise around the hips, the muscles for hip-turn can be stimulated.

These and other aspects of the disclosure will become more fully understood upon a review of the detailed description, which follows. Other aspects, features, and embodiments will become apparent to those of ordinary skill in the art, upon reviewing the following description of specific, exemplary embodiments in conjunction with the accompanying figures. While features may be discussed relative to certain embodiments and figures below, all embodiments can include one or more of the advantageous features discussed herein. In other words, while one or more embodiments may be discussed as having certain advantageous features, one or more of such features may also be used in accordance with the various embodiments discussed herein. In similar fashion, while exemplary embodiments may be discussed below as device, system, or method embodiments it should be understood that such exemplary embodiments can be implemented in various devices, systems, and methods.

DETAILED DESCRIPTION

Figure 1B:
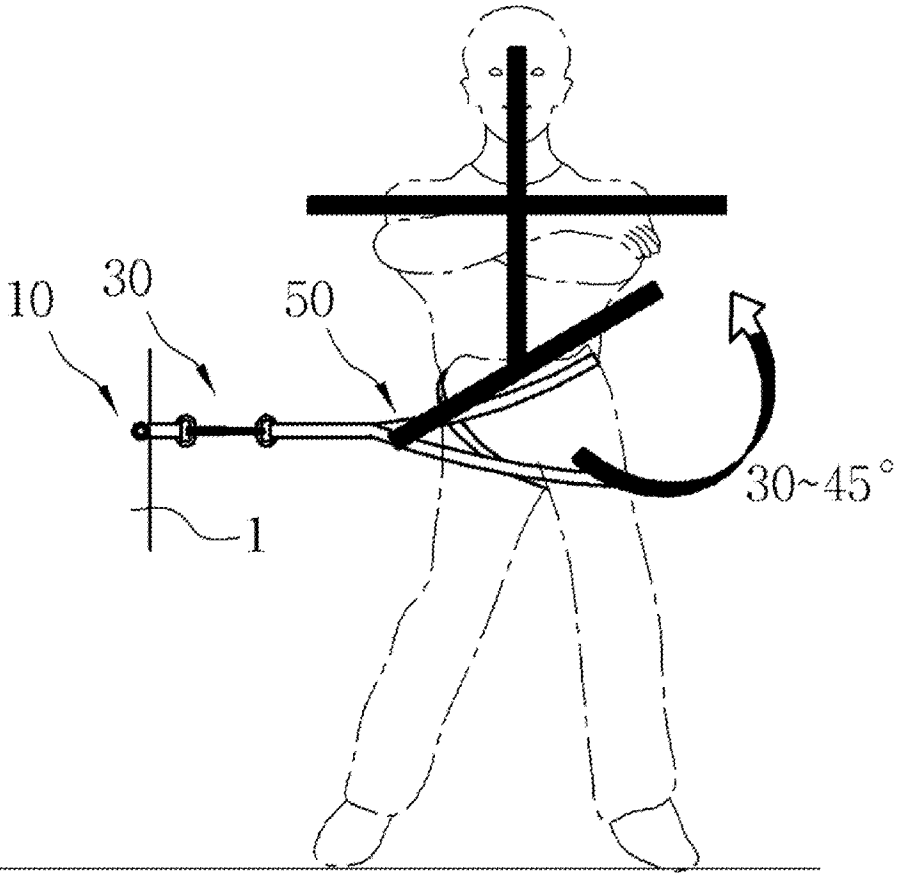
FIGS. 1A and 1B are example views illustrating the use state of a golf hip-turn training device according to some aspects of the disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

While aspects and embodiments are described in this application by illustration to some examples, those skilled in the art will understand that additional implementations and use cases may come about in many different arrangements and scenarios. Innovations described herein may be implemented across many differing platform types, devices, systems, shapes, sizes, packaging arrangements.

During a golf swing, a head position and a backbone angle should be maintained as much as possible to accurately and stably hit a ball with a golf club in impact.

That is, as for a right-handed golfer, it may be possible to maintain the backbone angle at address without a change of the head position and accurately hit a ball through a stable swing without rapid up, down, left, and/or right movements or reactions of the body only when a hip-turn of about 45 degrees is made while the left pelvis is moved backward in the impact with the ball.

Most amateur golfers make a mistake in that a hip-turn is made while the left pelvis is not moved backward but the right pelvis is moved forward in impact with a ball. In this case, an early extension, so-called belly bouncing, occurs, where the backbone bent at address is erected while the entire pelvis approaches the ball, which makes it difficult to accurately hit the ball.

Further, in a back swing, the body weight supported by the heel of the right foot should be moved to the heel of the left foot while the swing progresses in order to increase the carry, whereby impact power by moving the body weight is generated.

This motion is difficult to achieve unless a correct hip-turn is made first. That is, only when a correct hip-turn of moving the left pelvis backward is made first, the body weight may naturally be move to the heel of the left foot.

If the right pelvis is moved forward without the left pelvis moving backward, the body weight may remain at the right foot and a correct weight movement may not occur.

As described above, the correct hip-turn is very important for a golf swing. Further, the legs, hip muscles, and the core muscles of the abdominal muscles should be developed well and play an important role for correct hip-turn of moving backward the left pelvis and maintaining the backbone angle for address in impact.

It is generally believed that in order to develop such muscles, repeated practices are required and such practices may involve visiting specific places for golf practices, such as an indoor driving range or an outdoor driving range, and/or taking lessons from golf experts due to the feature of golf that is a sport using equipment called golf clubs.

At least for the reasons stated above, there is a need for a device enabling a user to train specific core muscles for a golf swing and to learn a correct swing posture, without being limited to a specific location (e.g., without having to travel to a golf specific locations such as a driving range).

A golf swing practice belt has been disclosed in Korean Patent Application No. 10-2005-0046260 in the related art. However, this golf swing practice belt is designed to enable a user to recognize the degree of a posture by feeling the close contact of a weight and hips, although it is difficult for beginner golfers to determine the degree of correction of a posture.

Further, there is a problem that it is impossible to assist training of muscles that are used for swing.

In addition, a device for correcting a golf swing posture has been disclosed in Korean Patent No. 10-1846927. However, this device is a posture correction set based on sensors of a plurality of head-up sensing unit, a sway sensing unit, a warning unit, and a correction control unit to which setting values are given. Accordingly, there is a problem in that individuals have to have expert knowledge to give appropriate specific values and the price is high, depending on the relevant parts. Further, there is a problem in that it is impossible to assist training of muscles that are used for swing.

Hereafter, a preferred aspect of a golf hip-turn training device according to the present disclosure is described in detail with reference to the accompanying drawings.

Aspects of the present disclosure are related to a training device to be fitted or worn on one leg of a user, to support portions between a latissimus dorsi muscle, a hip, and a femoral region, to strengthen core muscles that are used for a hip-turn by generating resistance against the hip-turn that occurs in a swing such as a golf swing, to induce correct hip-turn, and to enable a user to train at a desired place irrespective of place.

First, a correct hip-turn practice method using the golf hip-turn training device according to an embodiment of the present disclosure is described. In some aspects, it may be preferable to perform the method not quickly but slowly with accurate motions through the following steps.

1. Affix the training device to fixed object (e.g., a door anchor) and then put on the training device.

2. Take an address posture with both hands crossing on the chest without a club (e.g., golf club).

3. Maintain the head position and the backbone angle (left, right, forward, backward) as much as possible and make a hip-turn of about 45 degrees while slowly moving backward a first pelvis (e.g., left pelvis) without moving both shoulders.

4. Push the ground with the right leg while rotating the right foot inward when making a hip-turn, and simultaneously move the weight to the heel of the left foot.

5. Return to the initial posture and slowly repeat the above process several times while tightening the hip muscles and the abdominal muscles.

Meanwhile, it is possible to appropriately apply the training device to strengthen the core muscles of the user by increasing or decreasing the resistance by changing elastic bands (e.g., rubber bands) having different elasticity.

Figure 1A:
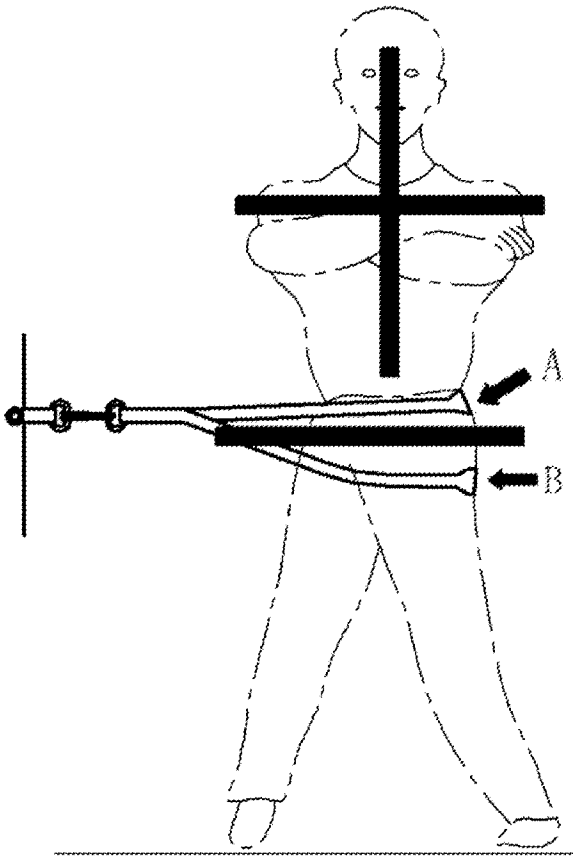

FIGS. 1A and 1B are example views illustrating the use state of a golf hip-turn training device according to some aspects of the disclosure. As shown in FIGS. 1A and 1B, the training device according to some aspects of the disclosure may help a user develop the core muscles through a resistance exercise using elastic bands (e.g., rubber bands) that may be replaceable. Further, the training device can be used with a door anchor Therefore, the training device may be made to be portable and can be carried easily and may be installed and used in any locations with an anchor such a door anchor, regardless of a location.

As described above, the standard of a correct hip-turn is maximally maintaining an inclined backbone angle and moving the left pelvis backward.

As shown in FIGS. 1A and 1B, for a right-handed user (golfer), the designed training device is held on the right thigh and goes around the pelvises. For example, the training device may include an anchor section 10, a resistance load section 30, and a strap section 50. The anchor section 10 may be coupled to a fixed object 1 (e.g., door knob) to be fixed in one position, and the strap section 50 is worn by the user on a thigh and around the pelvises, and the resistance load section 30 may connect the anchor section 10 to the strap section and may include the elastic band to provide elastic resistance.

In this state, a user directly feels resistance due to the elastic band at the points A and B shown in FIG. 1A. When a hip-turn is made as shown in FIG. 1B, the points where the user feels resistance are naturally pulled by the elastic band, whereby the hip muscles and the core muscles of the abdominal muscles that move the left pelvis backward may be developed, which is also shown in FIG. 6 as described below.

That is, using the training device, it is possible to correct the incorrect posture of the right pelvis protruding forward.

Further, development of core muscles of the user using resistance exercise suppresses movement and change of an axis due to momentum, which is generated by a swing, and enables the user to accurately hit a ball on the basis of the stable axis.

For example, when a right-handed golfer practices resistance exercise with a strap fit on the right leg near the crotch and then rotates counter-clockwise around the hips, the muscles for the hip-turn may be stimulated/exercised. Further, for example, when a left-handed golfer practices resistance exercise with a strap fit on the left leg near the crotch and then rotates clockwise around the hips, the muscles for the hip-turn may be stimulated/exercised FIG. 2 is an example perspective view showing a golf hip-turn training device 100 according to some aspects of the disclosure.

Figure 2:
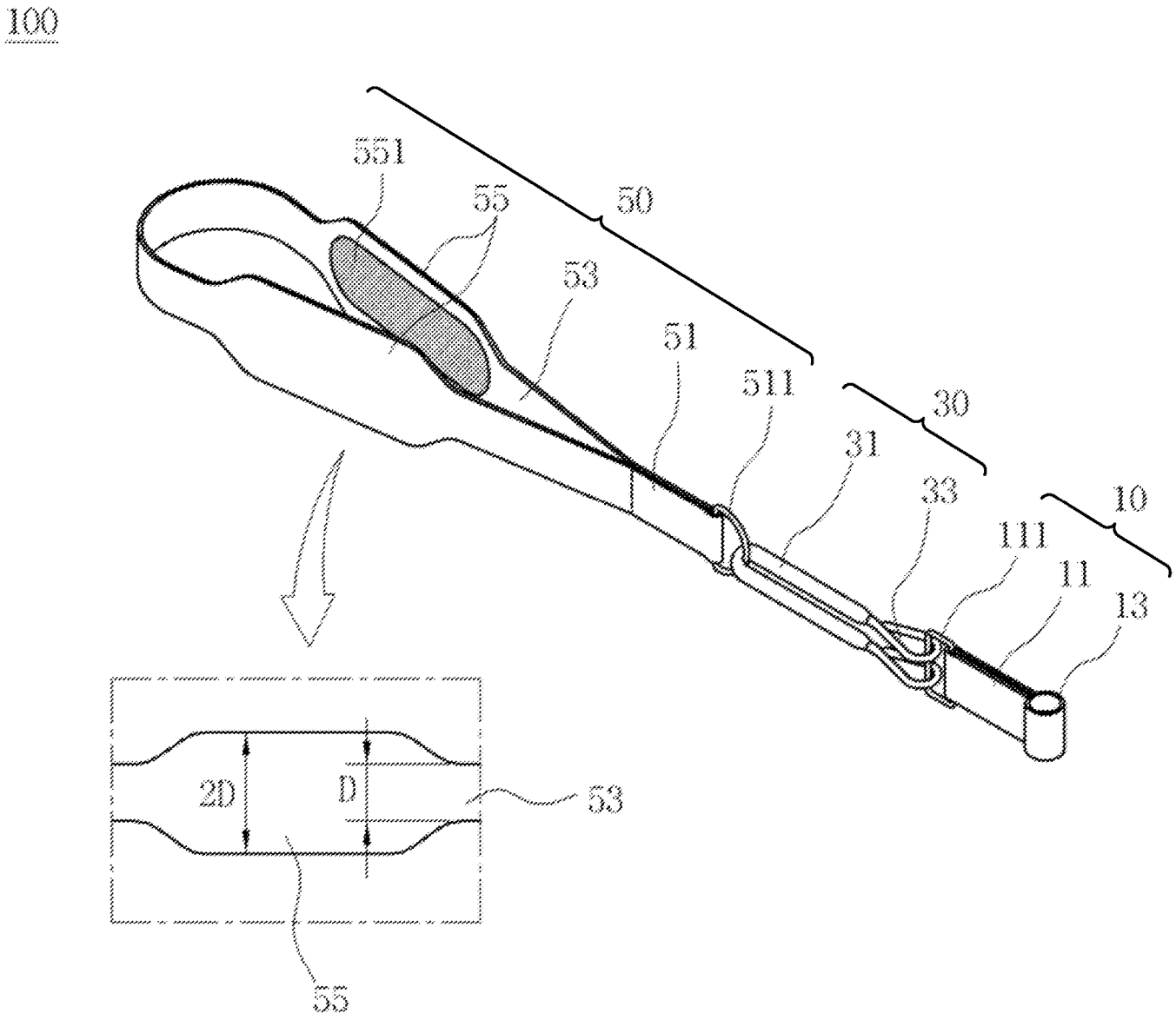
FIG. 2 is an example view showing the golf hip-turn training device according to some aspects of the disclosure.

As shown in FIG. 2, the golf hip-turn training device 100 may include the anchor section 10, the resistance load section 30, and the strap section 50.

The anchor section 10 may include a body 11 that has a band shape, where a first ring 111 is coupled at a second side of the body 11. The anchor section 10 may further include a fixer 13 that is formed at a first side of the body 11 and configured to be coupled to a fixed object, such as a door anchor. The first side of the body 11 may be on an opposing side from the second side of the body 11

The resistance load section 30 may include an elastic member 31 attached to a first side of the strap section 50. In some aspects, the elastic member 31 may have a rope shape and may pivot on the first side of the strap section 50. and the resistance load section 30 may further include one or more second rings 33 that are coupled to ends of the elastic member 31 and fastened to the first ring 111 of the body 11. In some aspects, the one or more second rings 33 may include two second rings 33 that are respectively coupled to two ends of the elastic members 31.

The strap section 50 may have a loop band (e.g., closed band) shape and may include a third ring 511 coupled to a first side of the strap section 50 to hold the elastic member 31 through the third ring 511. A second side of the strap section 50 may be formed to wrap around a hip and a portion of a femoral region of a user. The first side of the strap section 50 may be on an opposing side from the second side of the strap section 50. In some aspects, the strap section 50 may be made of a material that has little or no elasticity. In some aspects, the strap section 50 may be made of a soft material like pure cotton.

The fixer 13 may be configured to couple with a fixed object (e.g., fixed object 1), to be fixed in one position. In some aspects, the fixer 13 may be in a shape that corresponds to a shape of a fixed object, such that the fixer 13 may be firmly coupled with the fixed object. In some aspects, according to the example illustrated in FIG. 2, the fixer 13 may be formed in a circular pipe shape of which the longitudinal direction corresponds to the width direction of the body 11. This shape may correspond to a fixed object 1 having a small circumference, for example, a doorknob, an outdoor fence pillar, or the like. Further, the fixer 13 may be made of an elastic material to be able to be fitted irrespective of the shape of the fixed object 1 or may be made of Velcro to be firmly couple to the fixed object 1. When the fixer 13 is made of an elastic material, it should be designed to be fitted to and/or separated from the fixed object 1 only when a predetermined force is applied, so that the fixer 13 is not easily separated from the fixed object even by a repeated hip-turn motion of the golf swing, where the predetermined force needed for separating the fixer 13 from the fixed object 1 is greater than the force caused by the hip-turn motion. Further, if the fixer 13 is made of Velcro, a belt clip may be additionally coupled to prevent loosening due to repeated expansion and contraction of the elastic member 31. It is noted that the fixer 13 may be in a different shape and/or may include different features from the features of the fixer 13 shown in FIG. 2, as described below in reference to FIG. 3 and FIG. 4.

Further, in some aspects, the elastic member 31 may be a high-elastic rope or band made of synthetic resin or may include a high-elastic spring. The elastic member 31 may be replaceable/changeable, such that the user may try different elastic members of different elasticity and select the one that the user prefers for a particular type of training. For example, as described above, referring to FIGS. 5 and 6, the degree of hip-turn depends on a swing in golf, so it may be beneficial to be able to change the elastic member 31 to another elastic member with a different elasticity during training, to determine an appropriate resistance load in accordance with motions.

For example, it is possible to implement and use an elastic member 31 having resistance load of 2 kgf for an address swing, an elastic member 31 having resistance load of 4 kgf for a back swing and a down swing, an elastic member 31 having resistance load of 5 kgf for an impact swing, and an elastic member 31 having resistance load of 6 kgf for a follow throw and a finish swing.

The specific values of the resistance load described above are mere examples and do not limit the range of the resistance load of the elastic member 31 according to the present disclosure. Further, the intensity and/or the resistance load of the elastic member 31 may be changed in accordance with various conditions such as the physical strength and the amount of activity of individuals.

Further, the strap section 50, in more detail, includes an extension 51, a wrapper 53, and bases 55. In some aspects, the strap section 50 may be made by creating a loop with a strap such that the loop includes the extension 51, the wrapper 53, and the bases 55.

In some aspects, the extension 51 may be coupled to (e.g., wound through) the third ring 511 with the sides of the extension 51 facing each other being in contact with each other. For example, portions of the strap in the extension 51 that are facing each other may be attached to each other.

In some aspects, the wrapper 53 is formed in a loop band (e.g., closed band) shape corresponding to the other section except for the extension 51 such that a user's leg may be fitted therein.

In some aspects, the bases 55 may be formed by increasing the width of a predetermined region of the wrapper 53 to wrap around a hip and a portion of a femoral region. In some aspects, an anti-slip pad 551 may be disposed on the inner side of at least one of the bases 55. It is preferable that the bases 55 are disposed at symmetric positions to face each other. Accordingly, the bases 55 may wrap around a hip and a femoral region at the symmetric positions in both left hip-turn and right hip-turn, so a left-hander and a right-hander both may use the training device.

In some aspects, as shown in FIG. 2, it may be preferable that the width of the bases 55 is two times the width of the wrapper 53. The reason of making the bases 55 wider than the wrapper 53 is for preventing injuries such as grazing or scratching of the flesh due to the friction with the skin even if a user wears clothing and repeats a hip-turn motion with the bases in close contact with a hip and a femoral region, and for achieving stable fastening by increasing the contact area of the bases with a hip and femoral region. When the width of the bases 55 is less than two times the width of the wrapper 53, the bases 55 may be twisted like a rope. If this case is repeated, the flesh may be excessively pressed in a hip-turn motion, and thus the user may experience issues such as pain due to pressing and dull pain due to blocking of the blood. When the width of the bases 55 exceeds two times the width of the wrapper 53, flexibility may be decreased due to overlap of the two bases 55, and thus there may be issues in that the bases 55 may act as a factor that disturbs appropriate hip-turn. Further, it is preferable that the anti-slid pads 551 are formed by applying or attaching a material that easily generates friction and/or traction such as synthetic resin or silicone.

Figure 3:
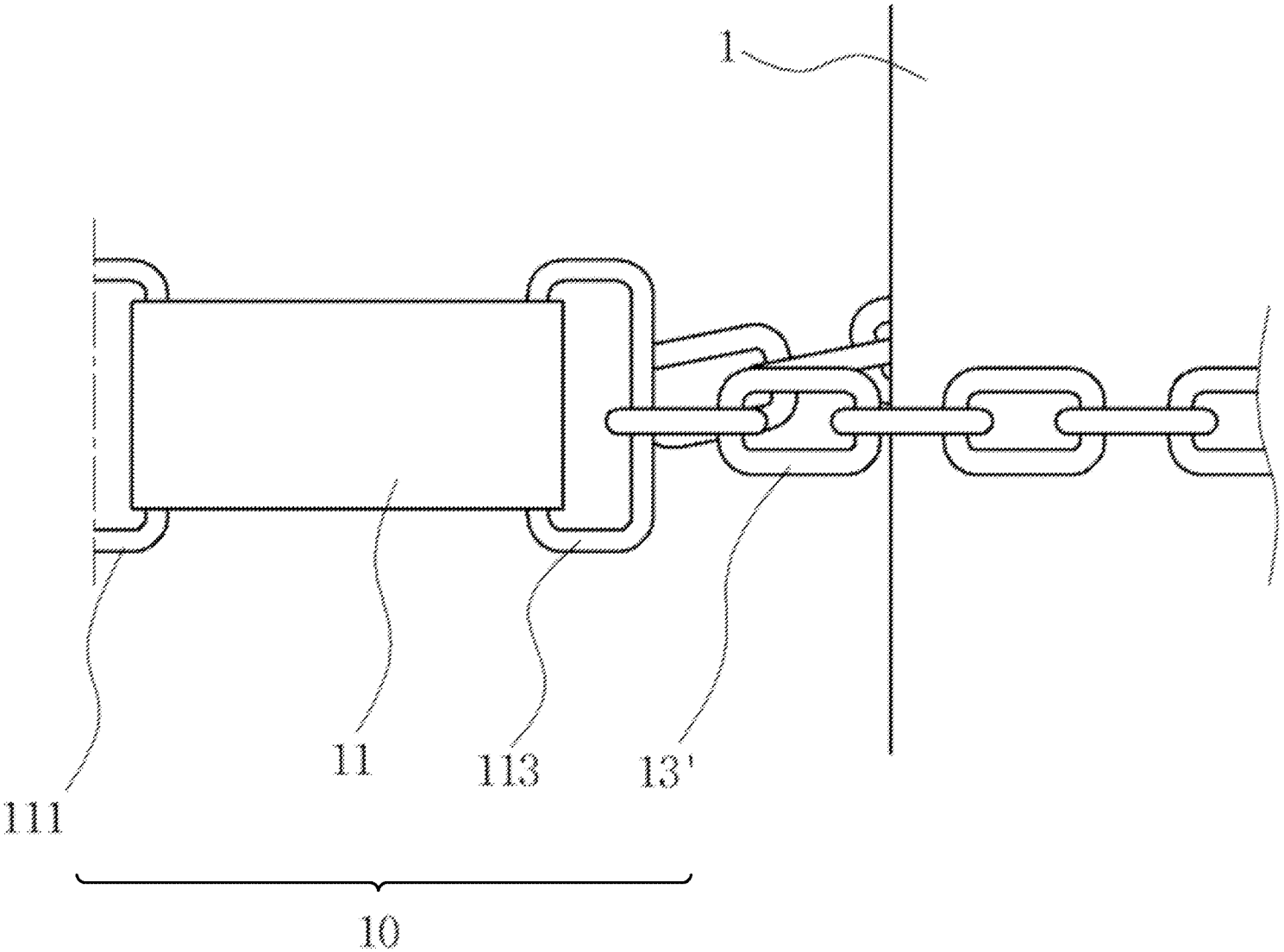
FIG. 3 is an example view showing another embodiment of the anchor section shown in FIG. 1, according to some aspects of the disclosure.
Figure 4:
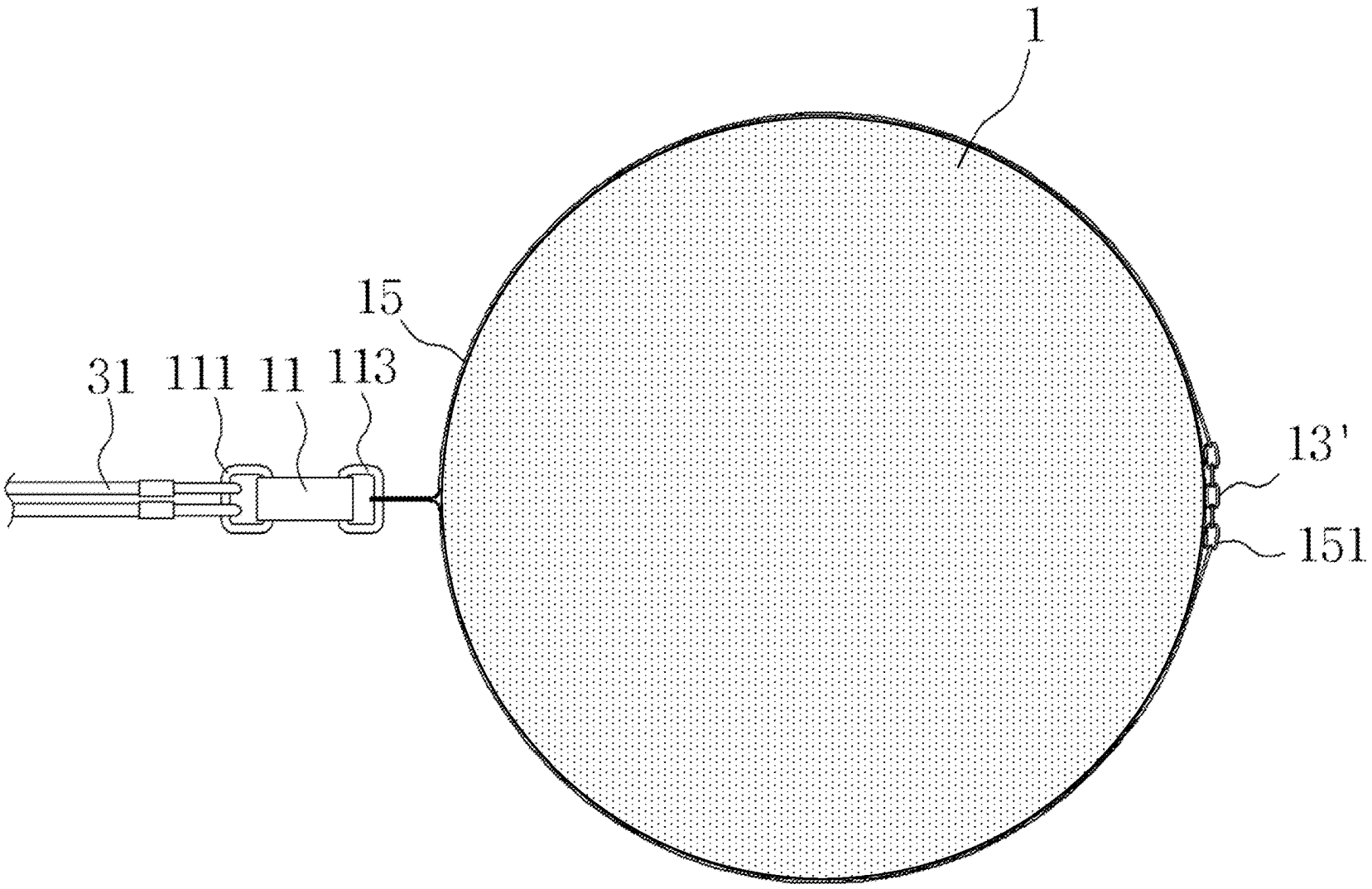
FIG. 4 is an example view showing another embodiment of the anchor section shown in FIG. 1, according to some aspects of the disclosure.

FIG. 3 is an example view showing another embodiment of the anchor section 10 shown in FIG. 1 and FIG. 4 is an example view showing still another embodiment of the anchor section 10 shown in FIG. 1.

As shown in FIG. 3, in one example, when the fixed object 1 to which the golf hip-turn training device 100 is coupled is relatively large or when the circumference of the fixed object 1 is large, it may be difficult to use the fixer 13 to couple with the fixed object 1. Further, in another example, even though the circumference of the fixed object 1 is small or the size thereof is relatively small, the fitting type may not be applied.

The anchor section 10, particularly, the fixer 13' shown in FIG. 3 is configured to be easily coupled to the fixed object 1 even in this case so that a user may conveniently practice hip-turn irrespective of place.

In more detail, the anchor section 10 may further include a fourth ring 113 coupled to the first side of the body 11 and the fixer 13' is a chain that is wound around a fixed object 1 and coupled to the fourth ring 113 at both ends, so the training device may be conveniently used even to a fixed object 1 having large circumference such as wood or a tree or a door or a column. It may be possible to prevent a damage such as caving or scratching on the fixed object 1 due to the chain by coating the chain-type fixer 13' with PVC or covering the chain-type fixer 13' with a protection cover such as a hose.

Further, as shown in FIG. 4, the anchor section 10 may additionally include an assistant fixer 15. In this case, the fourth ring 113 is coupled to the first side of the body 11, the assistant fixer 15 is wound through the fourth ring 113 and wound around a fixed object 1 (shaded region), and both sides of the fixer 13' of the chain-type are fastened to assistant rings 151 coupled to both ends of the assistant fixer 15 to wrap around a portion of the fixed object 1. This shape decreases the area of the fixed object 1 that generates friction with the chain, so there is an effect that it is possible to minimize a damage that may be generated on the fixed object 1, it is possible to minimize noise that may be generated due to friction between the chain of the fixer 13' and the fixed object 1, and above all, it is possible to reduce the load due to the chain.

Further, it may be possible to change the lengths of the chain-type fixer 13' and the assistant fixer 15 in accordance with the size or circumference of a fixed object 1. In this case, the assistant fixer 15 may be formed in a belt type such that a length may be freely adjusted.

Figure 5A:
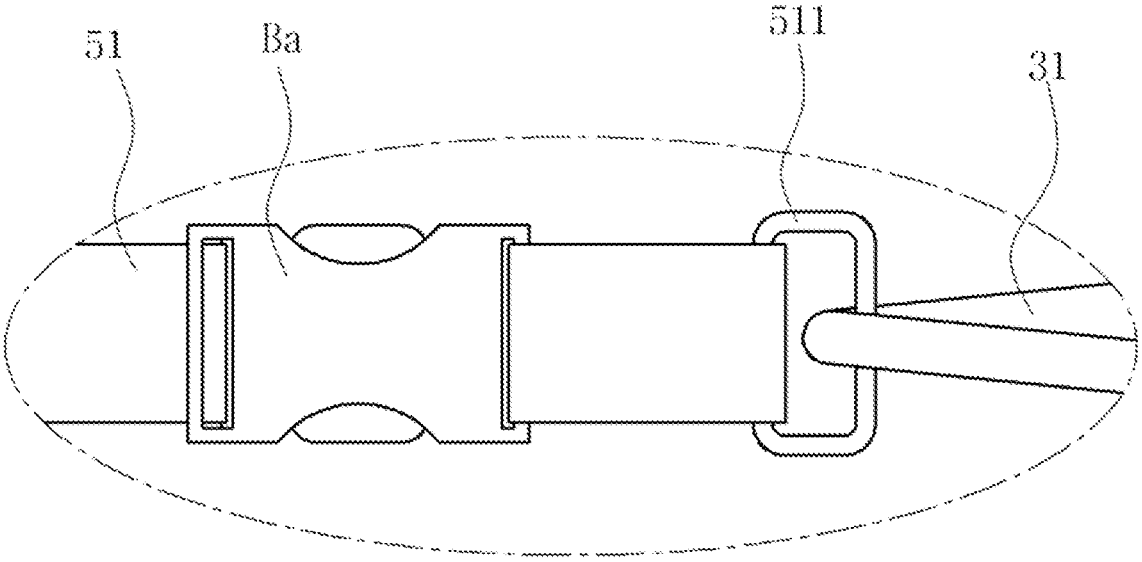
FIGS. 5A and 5B are example views showing another embodiment of the body and the extension shown in FIG. 2, according to some aspects of the disclosure.
Figure 5B:
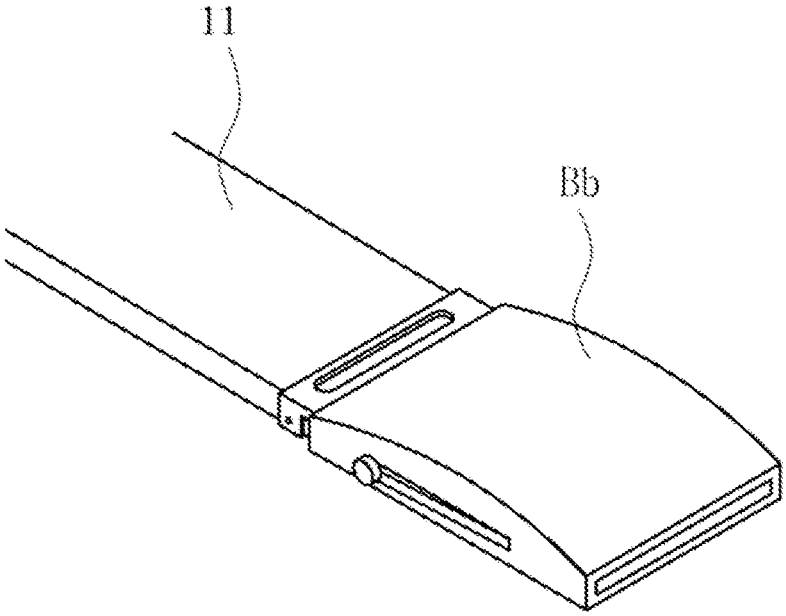

In some aspects, the body 11 may be configured such that a length of the body 11 may be adjusted. In some aspects, the extension 51 may be configured such that a length of the extension 51 may be adjusted. FIGS. 5A and 5B are example views showing other embodiments of the body 11 and the extension 51 shown in FIG. 2.

FIG. 5A is an example view showing a button-type fixing belt Ba and FIG. 5B is an example view showing a clip-type fixing belt Bb.

As shown in FIGS. 5A and 5B, the body 11 and/or the extension 51 may be formed in a belt type Ba and/or Bb such that a length of the body 11 and/or a length of the extension 51 can be adjusted. A hip-turn training space may be the outside or the inside of a building and various training environments may be given such as a relatively large or small gap, but the above configuration enables a user to freely adjust the length and train.

In some aspects, the first ring 111 to the fourth ring 113 and the assistant ring 151 may be metal rings such as a carabiner.

Figure 6A:
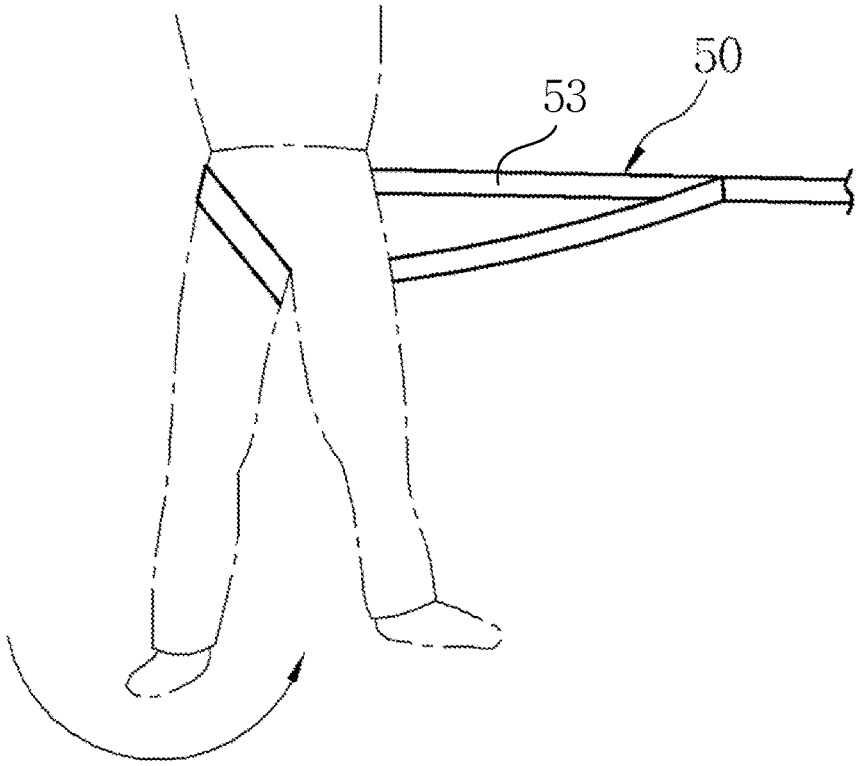
FIGS. 6A and 6B are example views showing methods of wearing the golf hip-turn training device shown in FIGS. 2 to 5, according to some aspects of the disclosure.
Figure 6B:
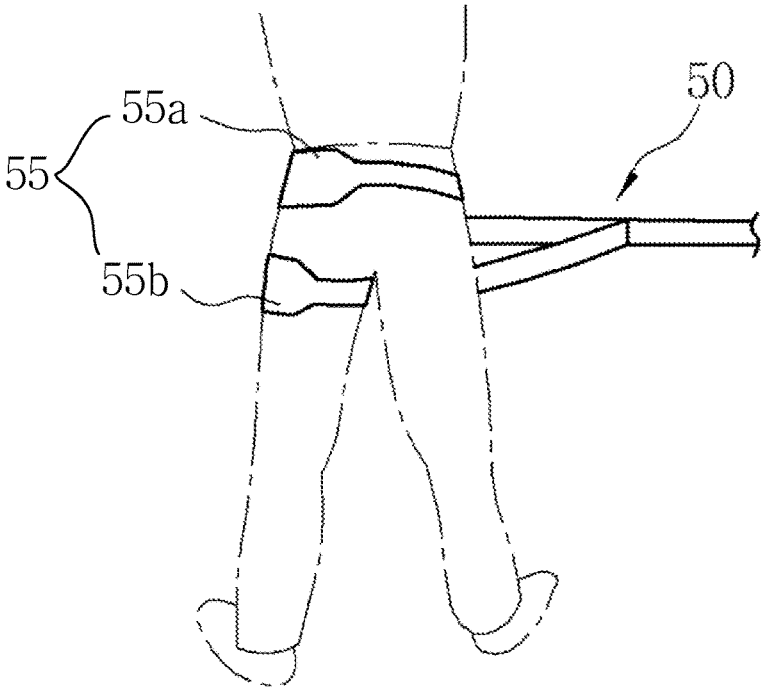

FIGS. 6A and 6B are example views showing a method of wearing the golf hip-turn training device 100 shown in FIGS. 2 to 5.

As shown in FIG. 6A, at first, a user puts on the wrapper 53 of the strap section 50 on the leg on an opposing side (e.g., farther away) from a fixed object 1 (e.g., by putting the leg through a loop of the wrapper 53) and then moves the wrapper 52 up to a hip. At this stage, the user may not put the other leg through the loop of the wrapper 53, the other leg being closer to the fixed object 1 than the leg wearing the wrapper 53. When putting on the wrapper 53 on the leg on the opposing side from the fixed object 1, the user may put one base 55*a* above the hip (or a top portion of the hip) and the other base 55*b* below the hip (or a bottom portion of the hip). Subsequently, the user rotates his/her body (e.g., 180 degrees) according to the direction of the arrow in FIG. 6A, and then, as shown in FIG. 6B, his/her body is turned to face an opposing direction such that the wrapper 53 wraps the front of the body.

In this case, in some aspects, it is preferable that the base 55*a* positioned above the hip wrap around the part between the upper portion of the hip and the latissimus dorsi muscle. Further, in some aspects, it is preferable that the base 55*b* positioned below the hip wraps around the part between the hip and the femoral region.

In some aspects, it is preferable that the training device is coupled to a fixed object 1 such that the body 11, the resistance load section 30, and the extension 51 are aligned in a straight line.

Hereafter, the way that the golf hip-turn training device 100 worn by the user induces a hip-turn is described in detail, according to some aspects of the disclosure.

Figure 7B:
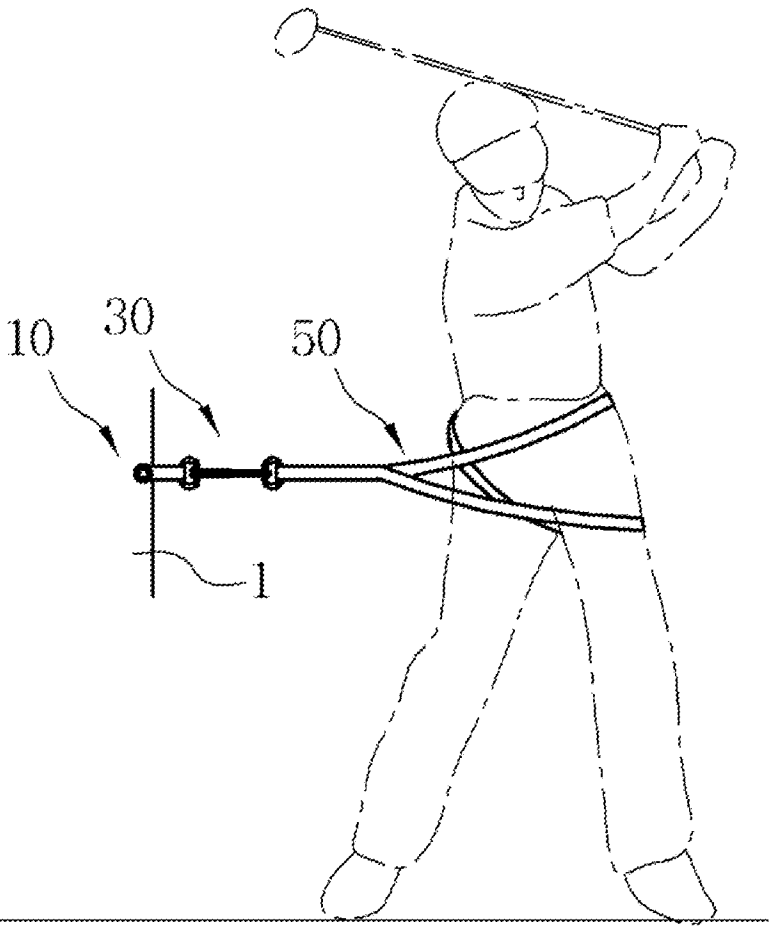
FIGS. 7A and 7B are example views showing a user wearing the golf hip-turn training device shown in FIG. 1 and practicing hip-turn for a half swing, according to some aspects of the disclosure.
Figure 7A:
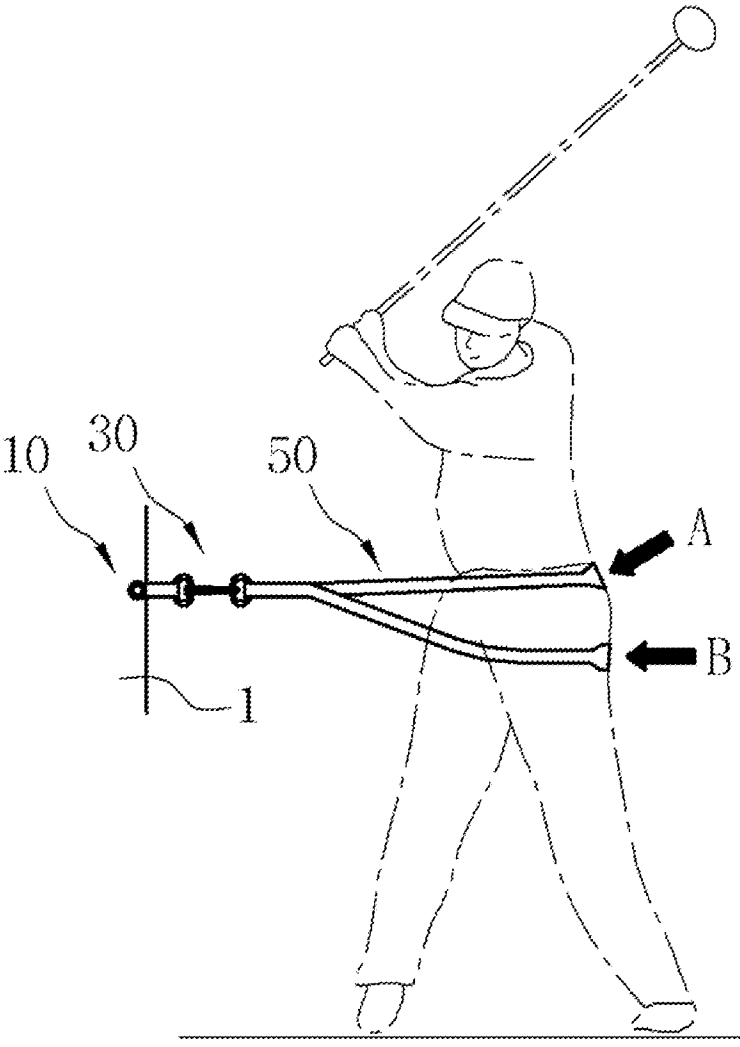
Figure 8B:
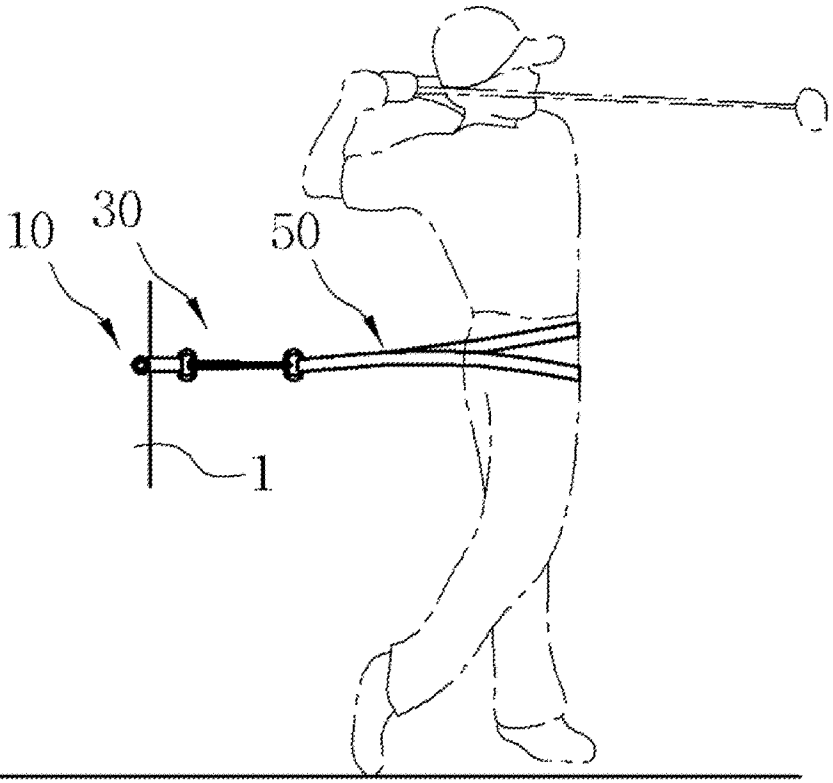
FIGS. 8A and 8B are example views showing a user wearing the golf hip-turn training device shown in FIG. 1 and practicing hip-turn for a full swing, according to some aspects of the disclosure.
Figure 8A:
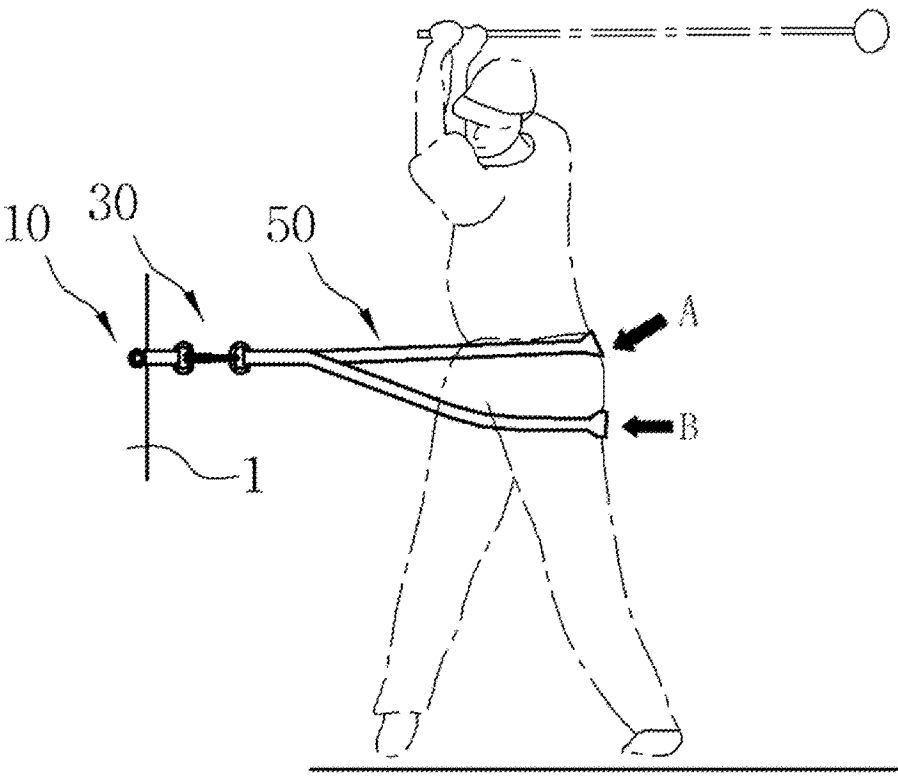

FIGS. 7A and 7B are example views showing a user wearing the golf hip-turn training device 100 shown in FIG. 1 and practicing hip-turn for a half swing and FIGS. 8A and 8B are example views showing a user wearing the golf hip-turn training device 100 shown in FIG. 1 and practicing hip-turn for a full swing. The designed training device is held on the right thigh and goes around the pelvises. In this state, a user directly feels resistance due to the elastic band at the points A and B shown in the figures.

As shown in FIGS. 7 and 8, the degree of a hip-turn depends on swing motions. As described above, the intensity of force for the hip-turn depends on the set resistance load of the elastic member 31. That is, core muscles are developed by resistance force that is generated when the elastic member 31 is extended by the hip-turn motion.

For a correct hip-turn motion, as described above, since the base 55 (e.g., base 55*a*) positioned above a hip should wrap around the part between the upper portion of the hip and a latissimus dorsi muscle and the base 55 (e.g., base 55*b*) positioned below the hip should wrap around the part between the hip and a femoral region, the present disclosure is characterized by inducing a correct hip-turn motion and simultaneously correcting the posture.

As a result, according to the present disclosure, since the training device is worn such that the strap section 50 strengthens the core muscles, that is, supports a latissimus dorsi muscle, a hip, and a femoral region, an individual may strengthen the core muscles for stable hip-turn even by himself/herself due to the interaction of the hip-turn direction and the resistance load for returning to the initial state of the elastic member 31.

Further, it is possible to determine whether the posture is correct or wrong on the basis of whether the bases 55 are kept in close contact, so an individual may achieve a stable hip-turn posture even by himself/herself.

Further, since the training device can be easily installed both the outside and inside of a building, it is possible to minimize costs such as a fee for using a particular space for practicing golf swings or a cost associated with carrying equipments/devices.

Although preferred embodiments of the present disclosure are described above with reference to the accompanying drawings, those skilled in the art would understand that the present invention may be implemented in various ways without changing the necessary features or the spirit of the prevent disclosure. Therefore, the embodiments described above are only examples and should not be construed as being limitative in all respects.

What is claimed is:

1. A golf hip-turn training device comprising:

an anchor section including a body that has a band shape, a first ring coupled at a second side of the body, and a fixer that is formed at a first side of the body and configured to be coupled to a fixed object;

a resistance load section including an elastic member that has a rope shape, and one or more second rings that are coupled to ends of the elastic member and fastened to the first ring; and a strap section having a loop band shape and including a third ring coupled at a first side of the strap section, the third ring configured to hold the elastic member and to enable the elastic member to pivot around the third ring, wherein a second side of the strap section is formed to wrap around a hip and a portion of a femoral region of a user when the strap section is worn by the user, wherein the strap section further includes:

an extension coupled to the third ring with sides of the extension facing each other being in contact with each other;

a wrapper connected with the extension and formed in a loop band shape to fit a user's leg through a loop of the wrapper; and a pair of bases, each formed by maintaining or increasing a width of a predetermined region of the wrapper to wrap around the hip and the portion of the femoral region when the strap section is worn by the user, each of the pair of bases having an anti-slip pad disposed on an inner side thereof, a width of each of the bases being two times a width of the wrapper, wherein the strap section is configured to be fit on a leg near a crotch and then wound around the hips.

2. The golf hip-turn training device of claim 1, wherein the fixer is formed in a circular pipe shape of which a longitudinal direction corresponds to a width direction of the body.

3. The golf hip-turn training device of claim 1, wherein the anchor section further includes a fourth ring coupled to the first side of the body and the fixer is a chain that is wound around the fixed object and coupled to the fourth ring at both ends, respectively.

4. The golf hip-turn training device of claim 1, wherein at least one of the body or the extension is formed in a belt type that enables adjustment of a length.

5. The golf hip-turn training device of claim 1, wherein the strap section is configured to be fit on a right leg near the crotch and then wound around the hips counter-clockwise for a right-handed golfer, and wherein the strap section is configured to be fit on a left leg near the crotch and then wound around the hips clockwise for a left-handed golfer.

6. A golf hip-turn training device comprising:

an anchor section including a first ring at one side and a fixer at another side, the fixer being configured to be coupled to a fixed object;

a resistance load section including an elastic member and a at least one second ring coupled to the elastic member and fastened to the first ring; and a strap section having a loop band shape and including a third ring coupled at a first side of the strap section to hold the elastic member and to enable the elastic member to move about the third ring, wherein a second side of the strap section is formed to wrap around a hip and a portion of a femoral region of a user when the strap section is worn by the user, wherein the strap section further includes:

an extension coupled to the third ring;

a wrapper connected to the extension and formed in a loop band shape to fit a user's leg through a loop of the wrapper; and a pair of bases, each having a width greater than a width of the wrapper and formed on a predetermined region of the wrapper, the pair of bases being configured to wrap around the hip and the portion of the femoral region when the strap section is worn by the user.

* * * * *